US010597259B2

(12) United States Patent
Wakasa

(10) Patent No.: US 10,597,259 B2
(45) Date of Patent: Mar. 24, 2020

(54) ELEVATOR APPARATUS WITH SEAL MEMBER AND LINK MECHANISM

(71) Applicant: TOSHIBA ELEVATOR KABUSHIKI KAISHA, Kawasaki-shi, Kanagawa (JP)

(72) Inventor: Miyuki Wakasa, Tokyo (JP)

(73) Assignee: TOSHIBA ELEVATOR KABUSHIKI KAISHA, Kawasaki-Shi (JP)

( * ) Notice: Subject to any disclaimer, the term of this patent is extended or adjusted under 35 U.S.C. 154(b) by 225 days.

(21) Appl. No.: 15/878,505

(22) Filed: Jan. 24, 2018

(65) Prior Publication Data

US 2018/0370770 A1 Dec. 27, 2018

(30) Foreign Application Priority Data

Jun. 23, 2017 (JP) ..... 2017-123740

(51) Int. Cl.
*B66B 13/28* (2006.01)
*B66B 13/30* (2006.01)

(52) U.S. Cl.
CPC ..... *B66B 13/28* (2013.01); *B66B 13/301* (2013.01); *B66B 13/308* (2013.01)

(58) Field of Classification Search
CPC ..... B66B 13/28; B66B 13/301; B66B 13/308; B66B 17/18
See application file for complete search history.

(56) References Cited

U.S. PATENT DOCUMENTS 2,739,354 A * 3/1956 Pope ..... B66B 17/18 187/400
2006/0243534 A1* 11/2006 Miller ..... B66B 13/301 187/313
2009/0301821 A1* 12/2009 Fujiki ..... B66B 13/26 187/400
2015/0096842 A1* 4/2015 Cao ..... B66B 17/18 187/337
2017/0137263 A1* 5/2017 Yoshida ..... B66B 13/308

FOREIGN PATENT DOCUMENTS

JP H06-305670 A 11/1994
JP H10-250962 A 9/1998
JP 2000-118930 A 4/2000
JP 3255868 B2 2/2002
JP 2014-141337 A 8/2014
JP 2017-013965 A 1/2017

* cited by examiner

*Primary Examiner* — Minh Truong
(74) *Attorney, Agent, or Firm* — Foley & Lardner LLP

(57) ABSTRACT

A side of the seal member 35 is provided rotatably to a car-side door sill 31. The rotation of the side allows the side to be displaceable between a sealing position and an evacuation position. The link mechanism for rotating the seal member 35 releases an engagement with the car-side actuating member to rotate the seal member 35 to a sealing position and fixes the seal member 35 at the sealing position. The link mechanism engages with the actuating member and releases the fixing of the seal member 35 at a sealing position when the car door moves to the door-close end.

4 Claims, 4 Drawing Sheets

ELEVATOR APPARATUS WITH SEAL MEMBER AND LINK MECHANISM

CROSS-REFERENCE TO RELATED APPLICATION

This application is based upon and claims the benefit of priority from the prior Japanese Patent Application No. 2017-123740 filed on Jun. 23, 2017, the entire contents of which are incorporated herein by reference.

TECHNICAL FIELD

An embodiment of the invention relates to an elevator apparatus having a structure for sealing a gap produced between an elevator lobby (landing) side door sill and a car side door sill both provided at an entrance of an elevator car.

BACKGROUND

In an elevator apparatus in which a car installed in a hoistway of a building moves up and down between floors to carry personnel and luggage, in order to raise and lower the car, a certain gap is provided between each floor and the car. For this reason, when the car is landed on the platform and doors of a doorway are opened, the gap appears between a doors sill of the platform side and the door sill of the car side. The gap between the door sills causes a person to trip or causes a wheelchair or a handcart to derail, thus being dangerous. Small goods including a key and a card can fall into a pit of the elevator apparatus through the gap, and are hard to retrieve in some cases.

An apparatus is proposed to seal the gap with a seal member when the door is open. See a patent document 1, for example, Japanese published unexamined application 10-250962.

In the apparatus in accordance with the patent document 1, a plate that seals the gap between the door sills is installed in the lower part of the car floor. When the door of the elevator apparatus opens, the plate rotates, so that the gap between the door sills is sealed by the plate.

The plate prevents things from falling into the pit of the elevator apparatus. The plate is rotated by being urged by the hinge and the return spring, and the gap is closed. The door presses the push-down lever provided on the plate side when the door is closed. As a result, the plate rotates against the urging force of the return spring, and the gap is released.

In such an apparatus, the push-down lever for rotating the plate pushes one end of the plate. As a result, the plate rotates. For this reason, when the width of the entrance to the car is large, a large operating force is required to operate the push-down lever for rotating the plate against the biasing force of the return spring. Therefore, the load on the door increases when the door is closed. Also, since the operation area of the push-down lever is widened, a large space is required for installation.

An object of the present invention is to provide an elevator apparatus having a mechanism capable of being installed in a small space, capable of closing a gap with a small force even when the width of the doorway is wide or when the gap between the doorways is wide.

The above object is realized by a seal member that mechanically interlocks with the opening and closing of the car door and closes the gap between the door sill on the landing side and the door sill on the car side. The seal member closes the gap by being pivoted by a link mechanism without requiring a large operating force.

DETAILED DESCRIPTION

Embodiments of the invention will be described specifically with reference to drawings.

Figure 1:
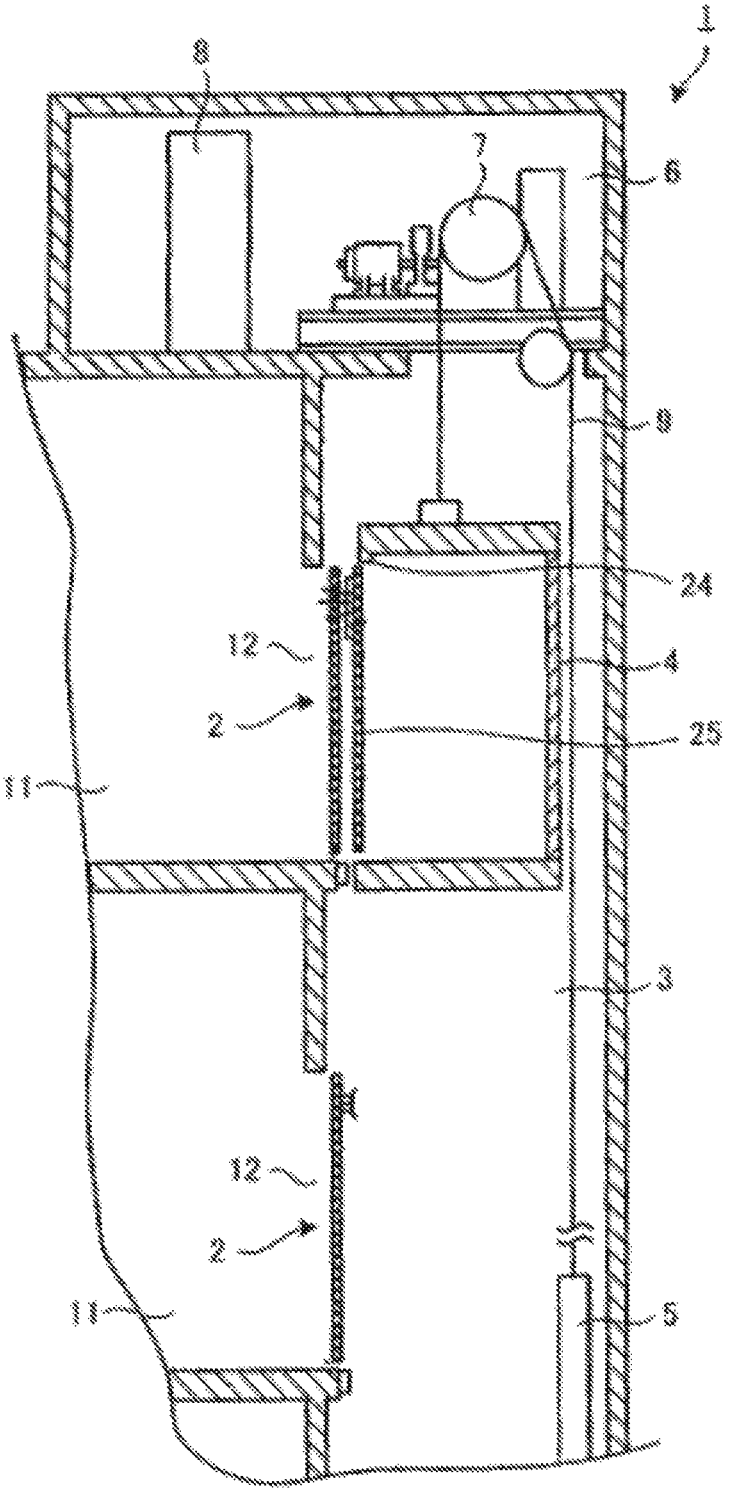
FIG. 1 is a whole structure of an elevator apparatus in accordance with an embodiment of the invention.

A whole structure of an elevator apparatus will be described below with reference to FIG. 1. As shown in FIG. 1, the elevator apparatus 1 is provided with a car 4 and a balancing weight 5 both being set up inside a hoistway 3. A machine house 6 is provided above a hoistway 3. The machine house 6 includes a winding machine 7 and a control apparatus 8. The control apparatus 8 controls a whole elevator apparatus 1, specifically controlling the winding machine 7 in response to calling from the landing or the car, and enables a car 4 to reach a landing which calls the car 4.

Furthermore, the elevator apparatus 1 may be an elevator without a machine house 6, i.e., a machine-house-less elevator having a downsized winding machine 7 or a downsized controller 8 on an upper portion of an inside of the hoistway 3.

In the elevator apparatus 1, an elevator lobby (landing) 11 is installed on each floor of a building. A doorway 12 leading to a car 4 inside the hoistway 3 is provided to the landing 11, and a landing door 2 is provided to the doorway 12. When the car 4 reaches the landing 11, the landing door 2 engages a car door 25 provided at a doorway 24 of the car 4 through an interlock mechanism not shown diagrammatically and opens/closes in conjunction with opening and closing of the car door 25.

Figure 2A:
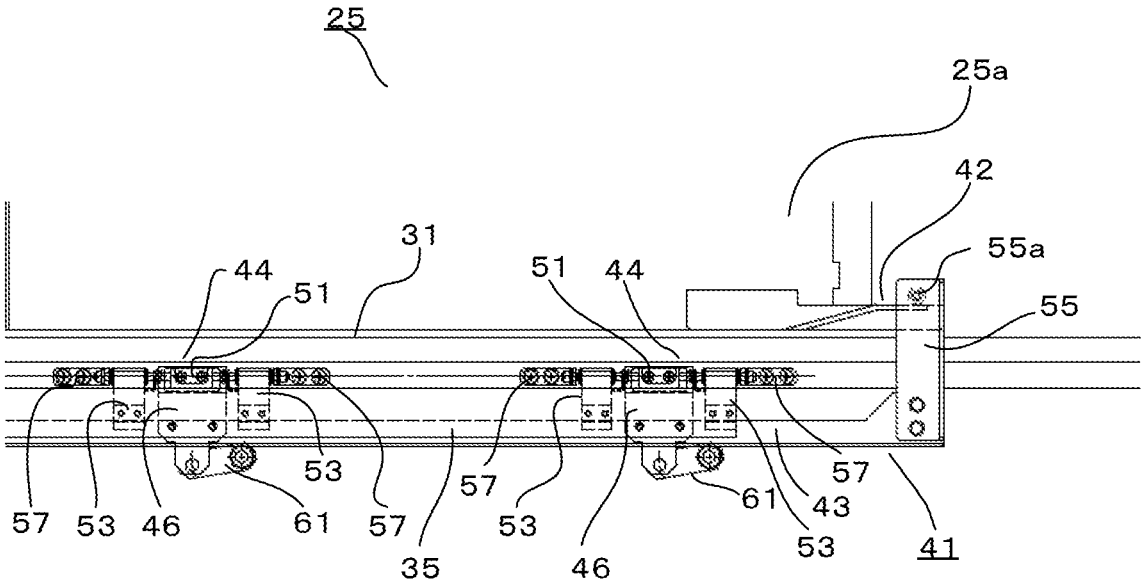
FIG. 2A is a front view of a car door viewed from a landing side in accordance with an embodiment of the invention, the front view showing a door-closing state.
Figure 2B:
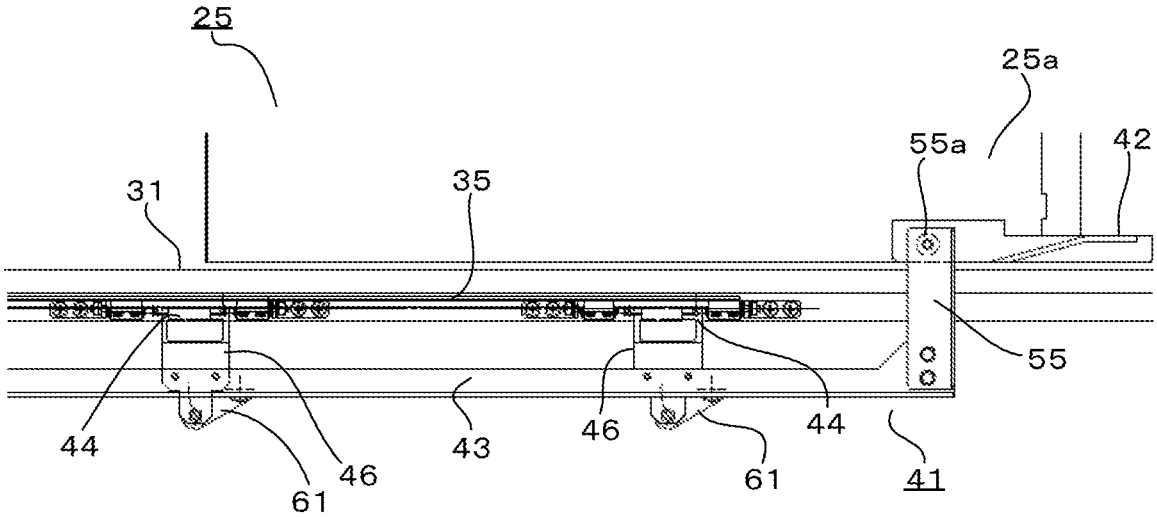
FIG. 2B is a front view of the car door viewed from the landing side in accordance with an embodiment of the invention, the front view showing a door-opening state.

FIGS. 2A and 2B are front views of the right side portion of the doorway of the car 4, the doorway being viewed from a side of a landing 11. The car door 25 has a left-and-right pair of door panels, and both the panels open. Only a right-side door panel 25*a* is shown in the figures. The door panel 25*a* will move to the right side of the figures when the car door 25 is opened. The car door 25 is connected to a door opening mechanism that is configured at a side of the elevator car 4, and is gated by the door opening mechanism.

The door opening mechanism is publicly known, and is not related directly to the present invention. Thus, an explanation of the door opening mechanism is skipped. The door panel 25*a* is geared to a left-side panel not shown in the figure by power of motor not shown in the figure and is driven in the right and left directions along a guide rail. Thus, the door opening mechanism gates the door panel 25*a*.

FIG. 2A shows a condition of the car door 25 fully closed. The left side shown of the door panel 25*a* is bonded to the right side not shown of the left-side door panel. FIG. 2B shows a condition of a start of opening the car door and a condition of the door panel 25*a* moved to the right direction shown in the figure.

A car-side door sill 31 is provided to the doorway of the elevator car 4, and enables the car door 25 to slide along the opening and closing direction. The car-side door sill 31 is provided to a hem side of the doorway 24 of the elevator car 4, and a guide groove on the upper side of the car-side door sill 31 engages with a lower end of the door panel 25*a* to guide the door panel 25*a* in the opening and closing direction.

Figure 4:
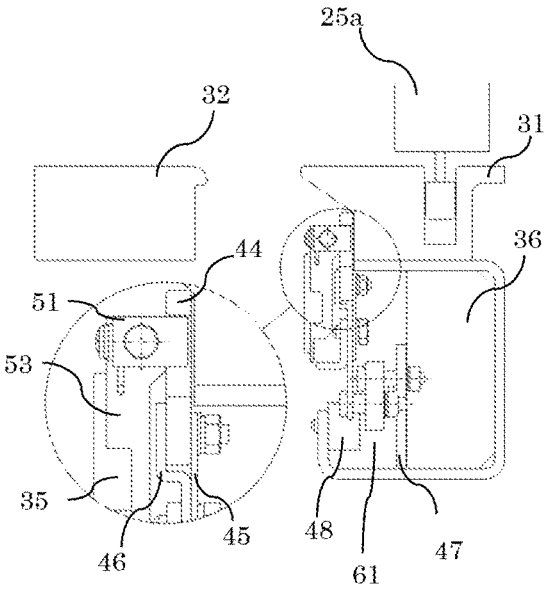
FIG. 4 is a side view showing a relation between the seal member at a retrieval position and the landing-side door sill.
Figure 5:
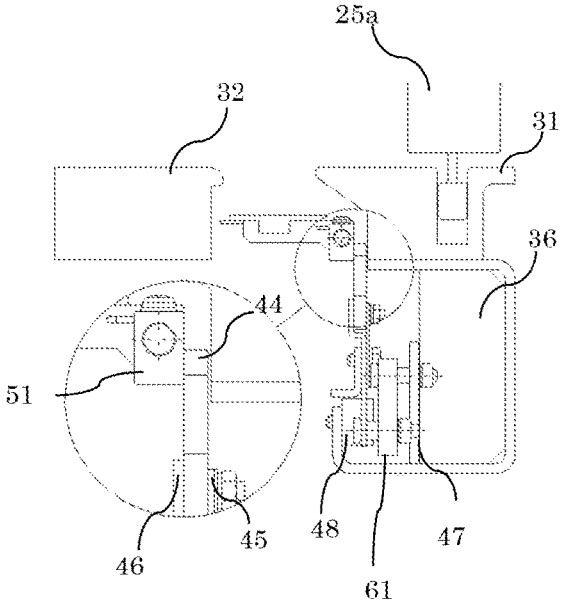
FIG. 5 is a side view showing a relation between the seal member at a sealing position and the landing-side door sill.

A door sill 32 is provided to the side of the landing 11, as shown in FIGS. 4 and 5, as well as the car-side door sill 31. The landing-side door sill 32 is arranged at a certain interval to face a side surface of the car-side door sill 31 (the left-side surface in FIGS. 4 and 5). A guide groove is formed on an upper side of the landing-side door sill 32, and makes the landing door 2 as shown in FIG. 1 slidable in the opening and closing direction. When the elevator car 4 reaches the landing 11, the landing door 2 engages with the car door 25 to open or close together with the car door 25. When the elevator car 4 does not reach the landing 11, the interlock mechanism locks the landing door 2 in a locked state. When the elevator car 4 reach the landing 11, the landing door 2 engages with an engage member not shown in the figure. The landing door 2 opens and closes in conjunction with the opening and closing of the car door 25.

When the elevator car 4 reaches a prescribed floor, a gap occurs between the car-side door sill and the landing-side door sill 32. In an embodiment of the invention, the gap is sealed with a plate-like seal member 35 shown in FIGS. 2 to 5 in accordance with an action of opening the car door 25. Details will be described below.

The seal member 35 has a shape that can seal the gap between the car-side door sill 31 and the landing-side door sill 32. In other words, the shape is longer than the width of the car-side doorway 24 and wider than the width of the gap between door sills 31 and 32 shown in FIGS. 4 and 5. Besides, the seal member 35 may be made of metal or resin, but it is better to use resin material from the view point of workability or shock-absorbing character with other parts.

Figure 3:
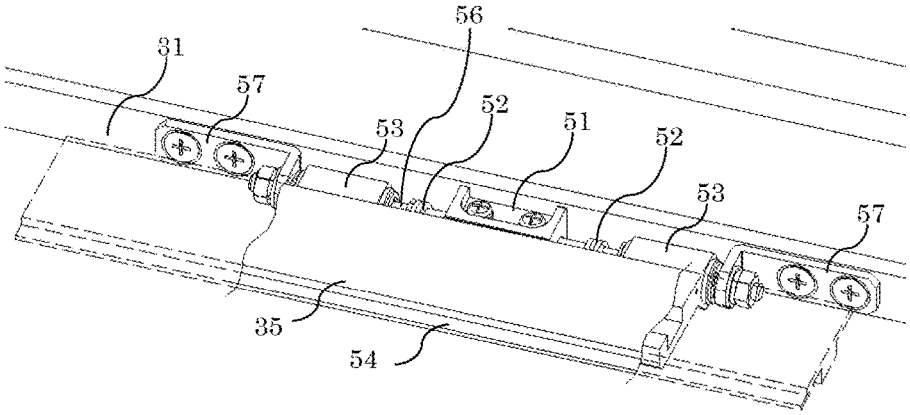
FIG. 3 is a diagrammatic perspective view of a relation between a seal member and a landing-side door sill in accordance with an embodiment of the invention.

A side of the seal member 35 is supported rotatably by a supporting member at the side of the door sill 31. Due to the rotation of the seal member 35, the seal member 35 moves the side between the sealing position for seal the gap of the door sills 31 and 32 shown in FIG. 5 and the evacuation position beneath the car-side door sill shown in FIG. 4. As shown in FIG. 3, a rotation shaft 56 is installed at the side of the seal member 35 by a shaft-attaching block 53, and the rotation shaft 56 is fixed to the car-side door sill 31 by a shaft supporting member 57.

The shaft-attaching block 53 has a composable shape. In the composable shape, the seal member 35 and each convexoconcave portion are engaged mutually. When plural shaft-attaching blocks 53 are provided on a side of the seal member 35, alignment of the rotation shaft 56 is easily obtained.

Figure 6:
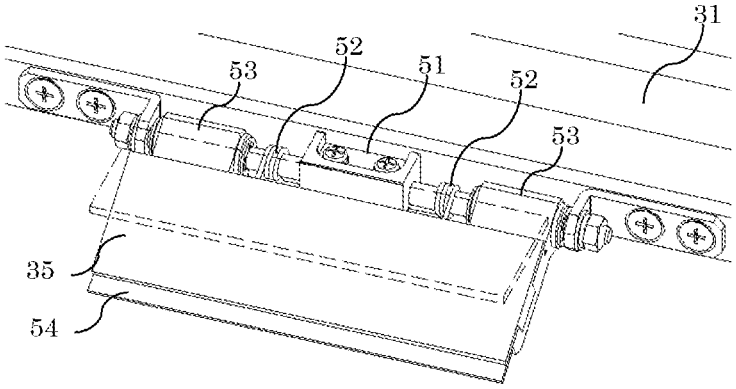
FIG. 6 is a perspective view showing a motion of the seal member.

On this rotating shaft 56, a rotation block is provided. As shown in FIG. 6, the seal member 35 is connected to the rotation block 51 via a buffering torsion spring 52. When the rotation block 51 is driven to rotate by a link mechanism 41 which will be described later, the seal member 35 follows and rotates due to the spring force of the torsion spring 52. The torsion spring 52 connects the rotation block 51 and the seal member 35 and operates as a buffer mechanism of the seal member 35 in the rotation direction.

As described above, the rotation block 51 is provided to the seal member 35 through the torsion spring 52. When a load is added to the seal member 35 at the sealing position, a rotation of the seal member 35 relative to the rotation block 51 is absorbed by a spring force of the torsion spring to avoid overload.

With this configuration, damage to the supporting portion of the seal member 35 can be prevented by applying a load to the seal member 35.

When the door starts to open from the door closed end (moves to the right direction shown in the figure), the link mechanism 41 for rotating the seal member 35 actuate after the link mechanism 41 is released from the engagement to the actuating member 42 on the side of the door panel 25*a*, and fixes the seal member 35 at the sealing position shown in FIG. 5 while rotating the seal member 35.

In other words, the actuating member 42 is provided to the right-side portion of the door panel 25*a* at the prescribed height through the oblique side shown in the figure.

The link mechanism 41 has an actuating bracket 55, an arm 43, and a link 61. The link mechanism 41 pull down a slide block 44 to a condition shown in FIG. 5 through a fixed member 46, rotates a rotation block 51 clockwise shown in the figure, and displaces the seal member 35 to the sealing position shown in FIG. 5.

The actuating bracket 55 configuring the link mechanism 41 is provided vertically to the right side end as shown in FIGS. 2A and 2B. A pin 55*a* engageable to the actuating member 42 is provided to the upper end of the actuating bracket 55. When the door panel 25*a* is located at the door-close end shown in FIG. 2A, the pin 55*a* is engaged on the actuating member 42 to keep the actuating bracket 55 at a prescribed height.

When the door panel 25*a* moves in the right direction by a door-opening action of the car door 25, the pin 55*a* is released from the upper surface of the actuating member 42 as shown in FIG. 2B. Thus, the actuating bracket 55 is released from the engagement with the slide block 44, and moves downward along the oblique side by the weight of the bracket 55 itself.

In contrast, when the door panel 25*a* moves from a condition of FIG. 2B to a condition of FIG. 2A, i.e., the left direction shown in the figure; the pin 55*a* of the actuating bracket 55 moves upwards along the oblique side of the actuating member 42. Thus, the pin 55*a* is engaged on the actuating member 42, and elevates the actuating bracket 55 to a prescribed height in the door-close end shown in FIG. 2A.

An end of the arm 43 is coupled with a lower end of the actuating bracket 55. The arm 43 is provided along a frontage direction of the doorway of the elevator car 4 provided with the car door 25, and is coupled with a beam 36 so as to be movable up and down. The arm 43 is provided to the beam 36 through a mounting base 47. Thus, the arm moves up and down accompanied with a vertical motion of the actuating bracket 55.

A slide block 44 formed like a picture frame is provided to the arm 43 through a fixed plate 46, as shown in FIGS. 4, 5, 7, and 8. The slide block moves up and down accompanied with a vertical motion of the arm 43. In other words, the link mechanism 41 has the slide block 44, and is provided to a car-side door sill beam 36 through the link 61.

When the seal member 35 is located at an evacuation position in FIG. 4, an end (right-side end shown in the figure) of the rotation block 51 is located inside a frame-like opening of the slide block 44. When the slide block 44 moves down, the right-side end of the rotation block 51 engaged therewith is pushed down. The rotation block 51 rotates clockwise as shown in the figure. The seal member 35 rotates in the same rotation direction to displace to the sealing position shown in FIG. 5.

At this time, the slide block 44 locates between the right side of the rotation block 51 after rotation and the side of the door sill member 31 to prevent the illustrated anticlockwise rotation of the rotation block 51. For this reason, the seal member 35 is maintained at the sealing position shown in FIG. 5. The slide block 44 moves down to be sandwiched between the rotation block and the car-side door sill 31, thereby fixing the seal member 35 at the sealing position.

On the other hand, as the door panel 25*a* moves to the left in the drawing when the car door is closed, as the operation bracket 55 and the arm 43 constituting the link mechanism 41 are raised as described above, the sliding block 44 also rises, the rotation block 51 is rotatable. For this reason, the seal member 35 rotates anticlockwise by its own weight and to be maintained at the evacuation position. The fix of the seal member 35 is released at the sealing position, and the seal member 35 is allowed to rotate to the evacuation position.

In this way, when the link mechanism 41 is released from the engagement with the actuating member 42 by the door opening operation of the car door 25, the link mechanism 41 moves down by the deadweight of the component parts. The link mechanism 41 engages with the actuating member 42 to be elevated. The slide block 44 is coupled with the link mechanism 41. When the link mechanism 41 moves down, the slide block 44 pushes down one end of the rotation block 51 to rotate the rotation block 51. The rotation block 51 is installed coaxially with the rotation shaft of the seal member 35 and is linked so as to be interlocked with the seal member 35. As the rotation block 51 rotates, the seal member 35 is rotated to a sealing position. On the contrary, the elevation of the slide block 44 releases the lock of the rotation member 51, thereby allowing the seal member 35 to rotate to the evacuation position.

The slide block 44 has a gap between the car-side door sill 31 and the slide block 44 so as not to graze against the car-side door sill 31. When a load is applied in the upper right direction of FIG. 5, the plate spring 45 shearing the slide block 44 with the fixing plate 46 bends to turn over the slide block 44 in the right direction. The above-described enables the sandwiched action mentioned above. When the slide block 44 displaces in the illustrated left direction, the engagement location between the slide block 44 and the rotation block 51 shifts to bring about the impossible of rotation. For this reason, the sliding block 44 is limited to displace in the left direction by the fixing plate 46.

A flexible tip member 54 is provided to the tip of the seal member 35 as shown in FIG. 6. The tip member 54 is provided as to be partially deformable in the rotation direction. The tip member 54 has a length that reaches from the front end of the seal member 35 to the lower portion of the landing-side door sill 32.

The configuration enables it to seal the gap between the door sills 31 and 32 with the seal member 35 and the tip member 54, thereby preventing the small things from falling into the pit through the gap and can be easily retrieved the small things.

The tip member 54 is formed of flexible substances including rubber, and is deformable at a tip location independently of the seal member 35.

Under such a sealing condition, the load of the elevator car 4 changes greatly to elevate the elevator car 4 slightly in some cases. Even such a temporal elevation of the elevator car 4 to contact the tip member 54 and the landing side door sill 32 will never give rise to damage or an insufficient rotation action of the seal member 35.

Figure 7:
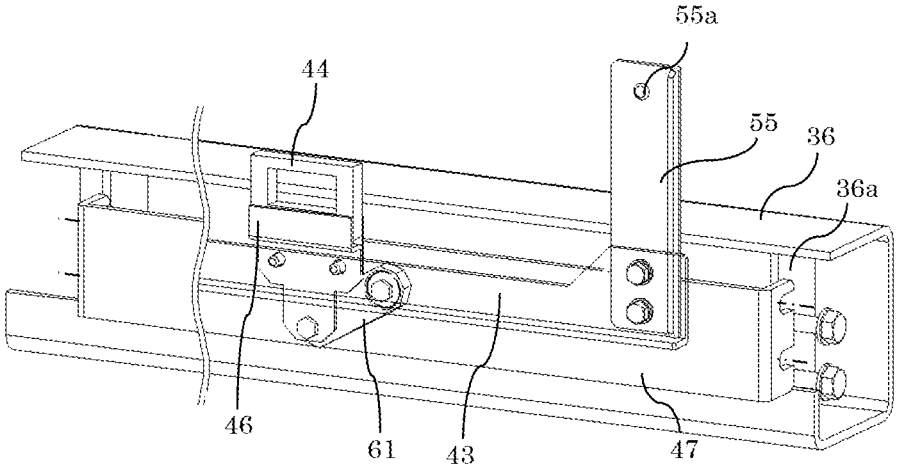
FIG. 7 is a view exemplifying how to provide a link mechanism.
Figure 8:
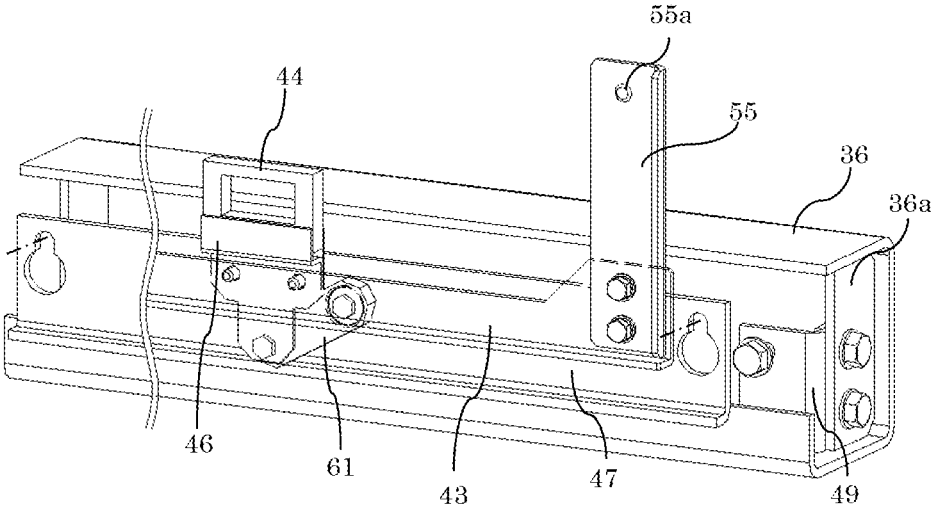
FIG. 8 is another view exemplifying how to provide a link mechanism.

The link mechanism 41 is provided to a reinforcing plate 36*a* of the car-side mounting beam 36 by the mounting base 47, as shown in FIG. 7. Even when the shape such as the thickness of the car-side mounting beam 36 is changed in accordance with the specification of the elevator car 4, the link mechanism 41 can easily cope with only by changing the location of the reinforcing plate 36*a*. As shown in FIG. 8, the mounting base may be provided to the reinforcing plate 36*a* through a mounting bracket 49. Mounting the mounting base 47 through a mounting bracket 49 enables it to adjust the location of the mounting base 47 in both the right and left directions, thereby requiring no high mounting accuracy for the reinforcing plate 36*a*.

Several embodiments of the invention have been described above. The embodiments are shown absolutely as examples of the invention. The above description is not intended to limit the scope of the invention. The novel embodiments can be employed variously. The embodiments can be omitted, replaced, and changed variously. The embodiments and the modified embodiments are included in the scope or summary of the invention and in the claimed invention and in the equivalents of the invention.

What is claimed is:

1. An elevator apparatus, comprising:

a car-side door sill configured to guide a car door provided in a doorway of an elevator car along its open/close direction;

a landing-side door sill configured to guide a landing door provided in a doorway to the elevator car in each floor where the elevator car can be landed along its open/close direction;

a seal member being displaceable between a sealing position and an evacuation position, the seal member being shaped so as to seal a gap occurring between the car-side door sill and the landing-side door sill, a side of the seal member being rotatably supported by a supporting member at the car-side door sill; and a link mechanism configured to releasably engage with an actuating member, wherein the link mechanism is configured to release from engagement with the actuating member at a car side to actuate when the car door starts to open from a door-close end, hold the seal member while rotating the seal member at the sealing position, release the holding of the seal member at the sealing position, and allow the seal member to rotate to the evacuation position, wherein the link mechanism, when released from the engagement with the actuating member, is configured to move downward by deadweight of component parts and to move upward by the engagement with the actuating member, wherein a slide block is configured to push down one end of a rotation block to rotate the rotation block to allow the seal member to rotate to the sealing position when the link mechanism moves down, wherein the slide block is configured to move upward to allow the seal member to rotate to the evacuation position, and wherein the slide block is configured to move downward to be sandwiched between the rotation block and the car-side door sill, thereby causing the seal member to be held at the sealing position.

2. The elevator apparatus, according to claim 1, wherein the rotation block is coupled with the seal member through a cushioning mechanism in the rotation direction.

3. The elevator apparatus, according to claim 1, wherein a tip member of the seal member is provided as to be partially deformable in the rotation direction.

4. The elevator apparatus, according to claim 1, wherein the link mechanism is provided on a reinforcing plate of the car-side door sill.

* * * * *